US008905143B2

(12) United States Patent
Joensen et al.

(10) Patent No.: US 8,905,143 B2
(45) Date of Patent: Dec. 9, 2014

(54) RISER CONFIGURATION

(75) Inventors: Arnbjorn Joensen, Aberdeen (GB); Julek Romuald Tomas, Aberdeen (GB)

(73) Assignee: Subsea 7 Limited, Sutton (GB)

( * ) Notice: Subject to any disclaimer, the term of this patent is extended or adjusted under 35 U.S.C. 154(b) by 12 days.

(21) Appl. No.: 13/511,142

(22) PCT Filed: Nov. 25, 2010

(86) PCT No.: PCT/GB2010/051972

§ 371 (c)(1), (2), (4) Date: Jul. 20, 2013

(87) PCT Pub. No.: WO2011/064591

PCT Pub. Date: Jun. 3, 2011

(65) Prior Publication Data

US 2013/0299179 A1 Nov. 14, 2013

(30) Foreign Application Priority Data

Nov. 25, 2009 (GB) ..... 0920640.0

(51) Int. Cl.
*E21B 17/01* (2006.01)

(52) U.S. Cl.
CPC ..... *E21B 17/012* (2013.01); *E21B 17/015* (2013.01)
USPC ..... 166/367; 186/350; 405/224.3

(58) Field of Classification Search
CPC ..... E21B 17/015
USPC ..... 166/367, 345, 350, 352; 405/168.1, 405/168.2, 169, 170, 171, 184.4, 405/224.2–224.4; 441/28, 29, 133
See application file for complete search history.

(56) References Cited

U.S. PATENT DOCUMENTS

| | | | | |
|---|---|---|---|---|
| 4,768,984 | A | 9/1988 | de Oliveira et al. | |
| 4,906,137 | A * | 3/1990 | Maloberti et al. | 405/224.3 |
| 5,505,560 | A * | 4/1996 | Brown et al. | 405/195.1 |
| 5,957,074 | A * | 9/1999 | de Baan et al. | 114/230.12 |
| 6,062,769 | A * | 5/2000 | Cunningham | 405/195.1 |
| 6,146,052 | A * | 11/2000 | Jacobsen et al. | 405/169 |
| 6,206,742 | B1 * | 3/2001 | Bull et al. | 441/1 |
| 6,595,725 | B1 * | 7/2003 | Shotbolt | 405/224.2 |
| 6,837,311 | B1 * | 1/2005 | Sele et al. | 166/353 |
| 6,854,930 | B2 * | 2/2005 | Pionetti | 405/172 |
| 7,040,841 | B2 * | 5/2006 | Kelm et al. | 405/224.2 |
| 7,367,398 | B2 * | 5/2008 | Chiesa et al. | 166/302 |
| 8,123,437 | B2 * | 2/2012 | Wolbers et al. | 405/172 |

(Continued)

FOREIGN PATENT DOCUMENTS

| | | |
|---|---|---|
| EP | 2 286 056 | 11/2009 |
| FR | 2 930 587 | 10/2009 |

(Continued)

OTHER PUBLICATIONS

NASI/API Specification 17J/ISO13628-02 for Unbonded Flexible Pipe (3d ed. Jul. 2008); "Part 2: Unbonded flexible pipe systems for subsea and marine application".

*Primary Examiner* — Matthew Buck
(74) *Attorney, Agent, or Firm* — Levy & Grandinetti

(57) ABSTRACT

A riser configuration having a rigid riser portion and a flexible riser portion. The riser configuration also includes a subsea buoy across which the riser portions are connected. Buoyancy means are mounted on the flexible riser portion.

19 Claims, 3 Drawing Sheets

(56) References Cited

U.S. PATENT DOCUMENTS

| | | | | |
|---|---|---|---|---|
| 8,136,599 | B2 * | 3/2012 | Alliot | 166/350 |
| 8,430,170 | B2 * | 4/2013 | Pionetti | 166/350 |
| 8,734,055 | B2 * | 5/2014 | Remery et al. | 405/171 |
| 2005/0063788 | A1 * | 3/2005 | Clausen | 405/224.2 |
| 2005/0158126 | A1 * | 7/2005 | Luppi | 405/224.2 |
| 2007/0003374 | A1 * | 1/2007 | Miorcec de Kerdanet et al. | 405/224 |
| 2008/0302535 | A1 * | 12/2008 | Barnes | 166/339 |
| 2010/0018717 | A1 * | 1/2010 | Espinasse et al. | 166/346 |
| 2011/0247826 | A1 * | 10/2011 | McCann | 166/337 |

FOREIGN PATENT DOCUMENTS

| | | |
|---|---|---|
| GB | 2 295 408 | 5/1996 |
| GB | 2 429 993 | 3/2007 |
| WO | WO 95/28316 | 10/1995 |
| WO | WO 03/097990 | 11/2003 |
| WO | WO 2008/107559 | 9/2008 |

* cited by examiner

RISER CONFIGURATION

The Application is the U.S. National Phase of International Application Number PCT/GB2010/051972 filed on Nov. 25, 2010, which claims priority to Great Britain Application Number 0920640.0 filed on Nov. 25, 2009.

This invention relates to a riser configuration, more particularly to an improved riser configuration which is particularly suited to deep water hydrocarbon production facilities and more directly to a hybrid riser comprising rigid and flexible components.

A significant proportion of hydrocarbons are found in subsea reservoirs some in shallow waters but many in deep water areas. As the cost of producing hydrocarbons from deep water areas is significantly higher than shallow areas, production has focused in the shallow areas and as the supply from these fields decreases, production has gradually moved to reservoirs in deeper waters.

Typically production from deep water fields is now being carried out at depths of over 2000 m. In these fields, rather than installing a platform which is supported on piles on the seabed, a floating production, separation and offloading vessel (FPSO) may be anchored at a suitable location offshore above the field. The produced fluids are recovered from one or more subsea wells to the seabed and then carried along pipelines laid on the seabed to the FPSO. The fluids are processed and stored on the FPSO before being transported for example by tanker to an onshore facility for further production or distribution.

The connection between the pipe line laid on the seabed and the FPSO is typically provided by a steel catenary riser (SCR) which is a heavy rigid steel pipe which is resistant to the corrosive effects of the fluids flowing therein.

The SCR is held in axial tension by buoyancy. The tension reduces the fatigue regime to which the SCR is exposed. This buoyancy typically can be supplied by a surface vessel such as the FPSO or a subsea buoy tethered to the seabed.

The closer the buoyancy approaches the surface of the sea, it becomes exposed to high currents and wave dynamic effects. The effect of these currents and waves may be felt down to around 300 to 400 m in some areas. As the SCR is rigid, any movement due to wave or current motion at the top is translated down the SCR to the pipe touch down point on the seabed, this can significantly increase the risk of fatigue damage. In extreme cases, this can lead to failure of the pipeline or spillage of hydrocarbons into the surrounding sea water. In either situation, this leads to downtime of the production facility which can represent a significant cost to the operator.

Additionally as any recovery operation or repair procedures must be carried out in deepwater, the cost and danger to personnel are similarly high.

In an effort to reduce the risk of damage to the SCR, a subsea buoy may be tethered at a depth below the high surface currents or high wave effected regions. The SCR may extend only from the subsea pipeline to the subsea buoy where it is coupled through a suitable connection to a flexible riser. The flexible riser then hangs between the subsea buoy and the FPSO, forming a sagging catenary profile. Therefore, only the Surface vessel, the FPSO and the connected flexible riser is subject to the local wave surges and current conditions whilst the SCR does not extend into the current profile and is not affected as much by surge and sway movement due to the waves or surface current. This connection system is sometimes called a "de-coupled system". Here the heave motions of the surface vessel are de-coupled from the subsurface buoy motions and thus the SCRs hanging from it. Some motion coupling still exists in such a system Whilst this solution addresses some of the problems with deep water subsea production, in practical applications a number of SCRs are connected to a single subsea buoy with a similar number of flexible risers connected between the buoy and the FPSO and maintaining the flexible risers in a configuration which limits damage to the SCRs and flexible risers and also managing the cost of installation of the system pose further problems which the present invention seeks to address.

It is therefore an object of the present invention to provide a riser configuration which can be installed in deep water whilst minimising the installation costs and limiting the risk of fatigue or failure of the SCR.

It is a further object of the present invention to provide a riser configuration in which the SCR is more effectively decoupled from the effects of wave or current fluctuations in the subsurface area.

It is a further object of the present invention to provide a riser configuration in which the SCR is more effectively decoupled from the dynamic effects of wave or current on the FPSO or other connected surface vessel.

According to one aspect of the present invention there is provided a riser configuration comprising a rigid riser portion and a flexible riser portion, a subsea buoy across which the riser portions are connected and wherein buoyancy means are mounted on the flexible riser portion.

Advantageously the buoyancy means are adapted to maintain the flexible riser portion above the rigid riser portion in the region of the connection.

Preferably the buoyancy means is adapted to maintain the flexible riser portion in a steep wave configuration.

Advantageously the buoyancy of the buoyancy means may be adjustable such that the depth of the flexible riser portion relative to the rigid riser portion may be controlled.

Preferably the rigid riser is a steel catenary riser.

Advantageously the subsea buoy is tethered to the seabed at a depth which is below the local high surface current profile band. Therefore the buoy is sheltered from the extreme movement in response to high current. Further, the increased mooring depth, takes the buoy out of the effective range of the wave induced motions as well.

An embodiment of the present invention will now be described with reference to and as shown in the accompanying drawings in which.

Figure 1:
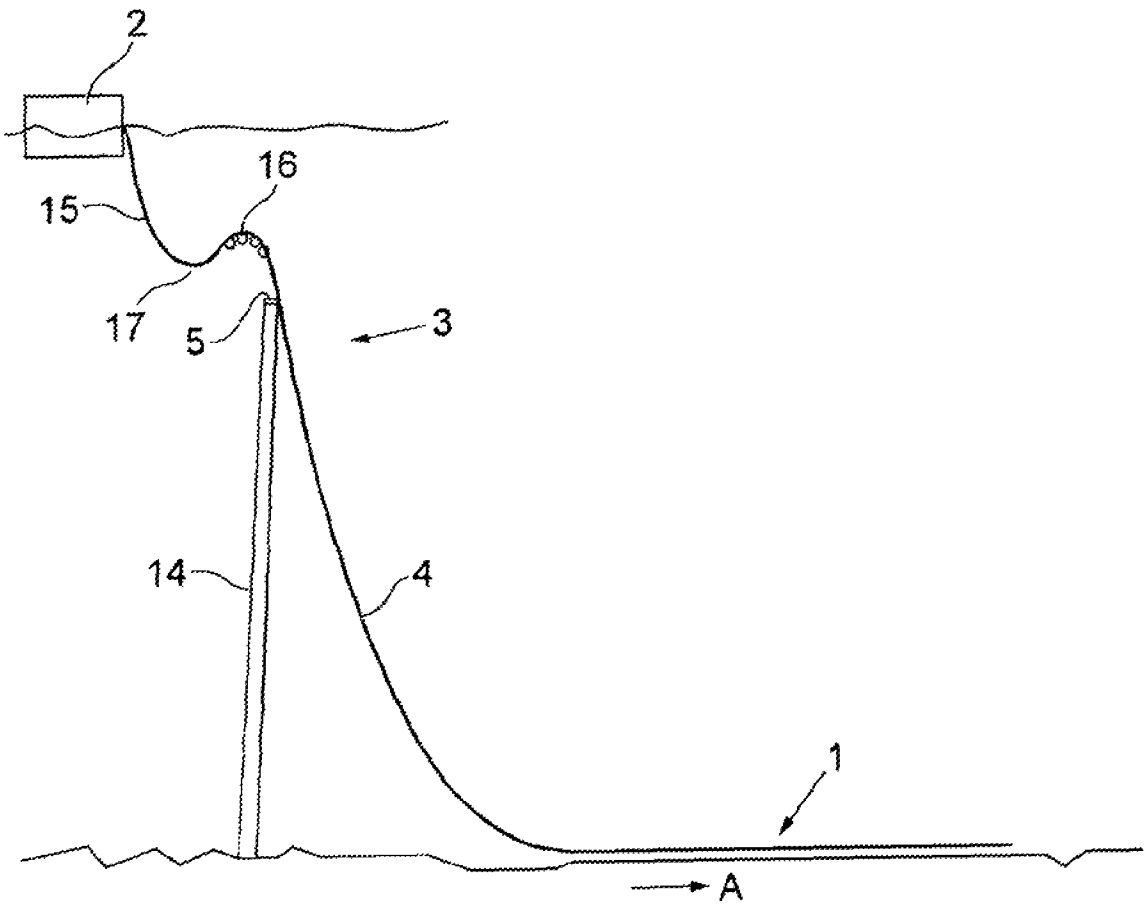
FIG. 1 is a schematic view of a riser configuration according to one aspect of the present invention.

Turning now to the Figures, FIG. 1 shows a riser configuration according to one aspect of the present invention. A pipeline 1 is laid along the sea bed for carrying produced fluids from a subsea well (not shown) to a processing facility such as for example an FPSO 2. A hybrid riser configuration 3 according to one aspect of the present invention is provided between the subsea pipeline and the FPSO for transporting produced fluids from the subsea pipeline to the surface.

The hybrid riser configuration comprises an SCR 4 which is connected to the end of the subsea pipeline through a standard pipeline connector (not shown) or pipeline end termination. A back tension is applied to the SCR in the direction of arrow A, either from frictional contact with the seabed or alternatively from an anchor device such as a suction or gravity anchor secured to the seabed to counteract the forces acting on the SCR from self weight, the fluids flowing therein and the surrounding seawater and currents.

Figure 2:
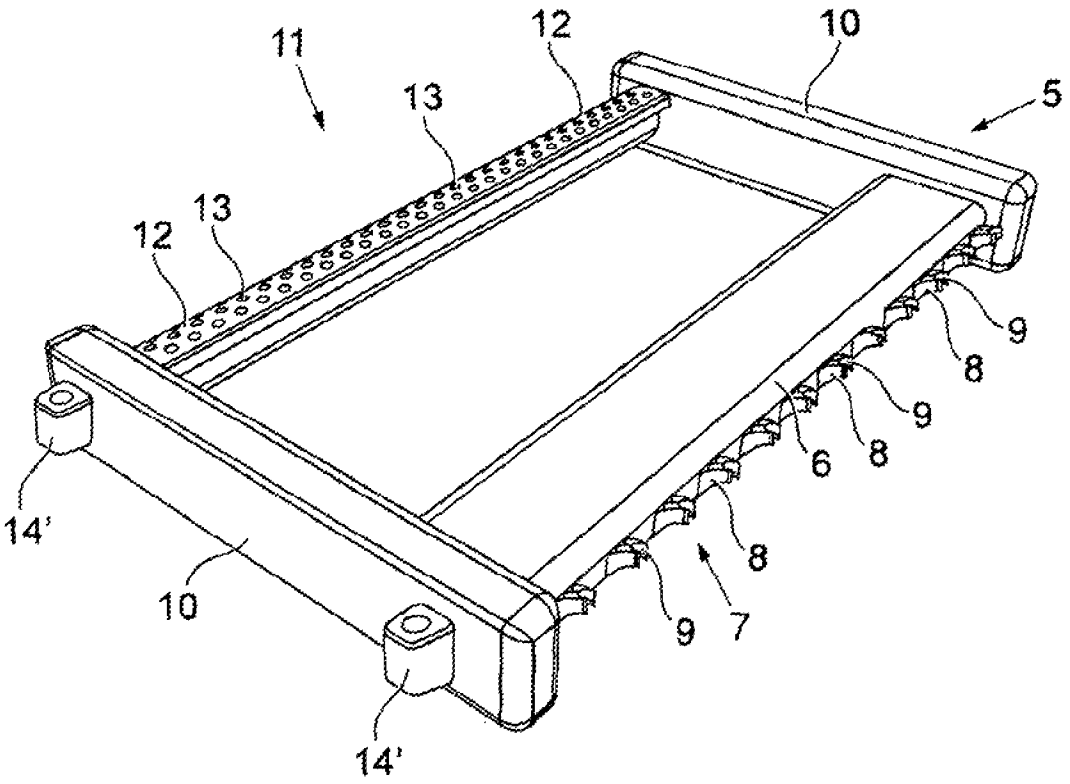
FIG. 2 is a perspective view of a subsea buoy of the riser configuration of FIG. 1.

The free end of the rigid SCR is supported above the seabed by a subsea buoy 5, such as is shown in more detail in FIG. 2. The SCR is laid under tension from the pipeline end termination up to the buoy.

The buoy comprises a buoyancy tank 6 which in the illustrated embodiment is a substantially rectangular body. The tank may comprise a single internal chamber or alternatively a plurality of internal chambers which may be linked to or isolated from one another. Means (not shown) are provided for introducing fluids into or removing fluids from the tank in order to alter the buoyancy of the tank and therefore the depth of the subsea buoy and thus the height of the free end of the SCR 4 above the seabed. In some conditions the buoyancy of the tank may be increased to provide an over-buoyant tethered system which provides lateral stiffness in the prevailing subsea currents. It will be appreciated that the tank may withstand partial flooding without affecting the functionality of the buoy.

A vertical bulkhead (not shown) extends through the tank and where separate chambers are provided, through the individual chambers to provide structural stiffness and stability to the buoy. Preferably the bulkhead extends through the centre of the tank.

One or more connectors 7 are provided on the buoy 5 for securing the free end of the SCR to the buoy. In the illustrated embodiment a plurality of connectors 7 are provided along one side of the tank 6.

These connection points may be replaced on the buoy from a surface vessel without the need of surfacing the buoy.

Where a plurality of chambers are provided, Individual chambers of the tank may be designated to support individual SCR coupled to the connectors or an individual compartment may support a group of SCRs coupled to connectors mounted on that chamber. Fluids may be introduced into the chambers such that different chambers have different buoyancy and indeed adjacent chambers may have different buoyancy. This may depend upon the SCR or group of SCRs supported on each chamber.

Each connector comprises an arm 8 which extends laterally from the side of the tank with a socket 9 at the free end of the arm for receiving an SCR. The size and seat angle of the socket may be variable in order to receive SCRs of different diameters and catenaries.

A structural frame member 10 is mounted at either end of the tank. The frame members 10 function to hold the tank 6 in a preferred horizontal orientation. A pontoon 11 is mounted between the frame members substantially parallel to the tank. The pontoon is used during floatation of the buoy to a subsea location for stability. The upper surface of the pontoon may support a curved shoe 12 which in the preferred embodiment comprises a metal plate with a smooth outer surface. The shoe is provided with a plurality of guide members 13 which may comprise channels or baffles or apertures for example in or upon the curved surface. The shoe provides support for umbilicals mounted on the buoy.

An alternative arrangement may involve removable, lightweight composite structures which facilitate the guidance of the umbilical over the upper surface of the buoy.

One or more connection points 14' are provided on the subsea buoy for connection of tethers 14 to anchor the buoy to the seabed. The connection points are standard components which could for example comprise a boss extending from the frame member with an aperture therethrough such that the tether can be passed through the aperture and tied off to secure the buoy to the sea bed.

The tethers are preferably sheathed spiral wires which may be fitted complete with connectors and chains. Preferably one such tether is mounted to the subsea buoy at each corner.

The present invention further comprises a universal interface system to facilitate mounting of all external appendages such as the moorings, SCRs, even the towing connections to the subsea buoy.

These structures would have features which allow replacement from a surface vessel such as far example double tee-slot and guide post interfaces designed to transfer structural loads from the hang-off to the structure of the buoy.

The SCR mounting means may comprise flexjoints or taperjoints.

A standard riser connection (not shown) is provided at the free end of the SCR 4.

A flexible riser 15 is connected to the free end of the SCR 4 via a diverless vertical connector. The flexible riser extends from the free end of the SCR to the FPSO 2 on the surface. A support member known as a "goose kneck" (not shown) is mounted on the flexible riser above the vertical connector to support the change in angle of the flexible riser above the buoy.

Flexible bend restrictors (not shown) are positioned on each end of the flexible riser. Buoyancy means 16 are provided on the flexible riser to raise the portion of the flexible riser adjacent the subsea buoy 5 and the connection with the SCR, above the height of the free end of the SCR 4 and above the subsea buoy.

The buoyancy means 16 may be adjustable such that the height of the flexible riser from the connection point with the SCR to the buoyancy means can be adjusted. The buoyancy means may be provided by any known devices such as one or more collars which surround the flexible riser or one or more buoyant modules which are tethered to the flexible riser.

The flexible riser 15 is held in a steep wave configuration above the subsea buoy 5 wherein the flexible riser rises steeply from the subsea buoy for a short distance of 50 m for example before sagging back downwards in a loop 17 between the buoyancy means 16 and the FPSO 2. The loop is know as a "sag bend" and the buoyancy means ensures that the sag bend is held away from the subsea buoy to prevent damage to the flexible riser by contact with the subsea buoy. In some embodiments the sag bend may extend below the depth of the buoy. In this way the flexible riser is maintained in a condition with two bends between the connection with the SCR and the FPSO which provides in effect a double motion absorbing effect in relation to any motion of the FPSO or the flexible riser due to wave or current conditions.

It will be appreciated that the majority of the flexible riser 15 can be suspended at a depth below the current profile for the area. This minimises the motion of the buoy, and thus the motion of the SCR. Deeper buoy location means that the length of the SCR is reduced and as such the size of the buoyancy requirement can be reduced as well, resulting in a smaller and cheaper buoy.

As the weight of the flexible riser 15 is now self supporting (by flexible based buoyancy modules 16), the size of the buoyancy in the buoy 5 can be reduced resulting in a smaller buoy with a reduction in the dynamics of the buoy.

It will also be appreciated that the structural elements of the buoy do not have to withstand current or wave surges and this also provides scope for reducing the size of the buoy.

Furthermore, as the size of the subsea buoy 5 is reduced, the weight of the tethers 14 anchoring the subsea buoy to the sea bed can also be reduced.

Figure 3:
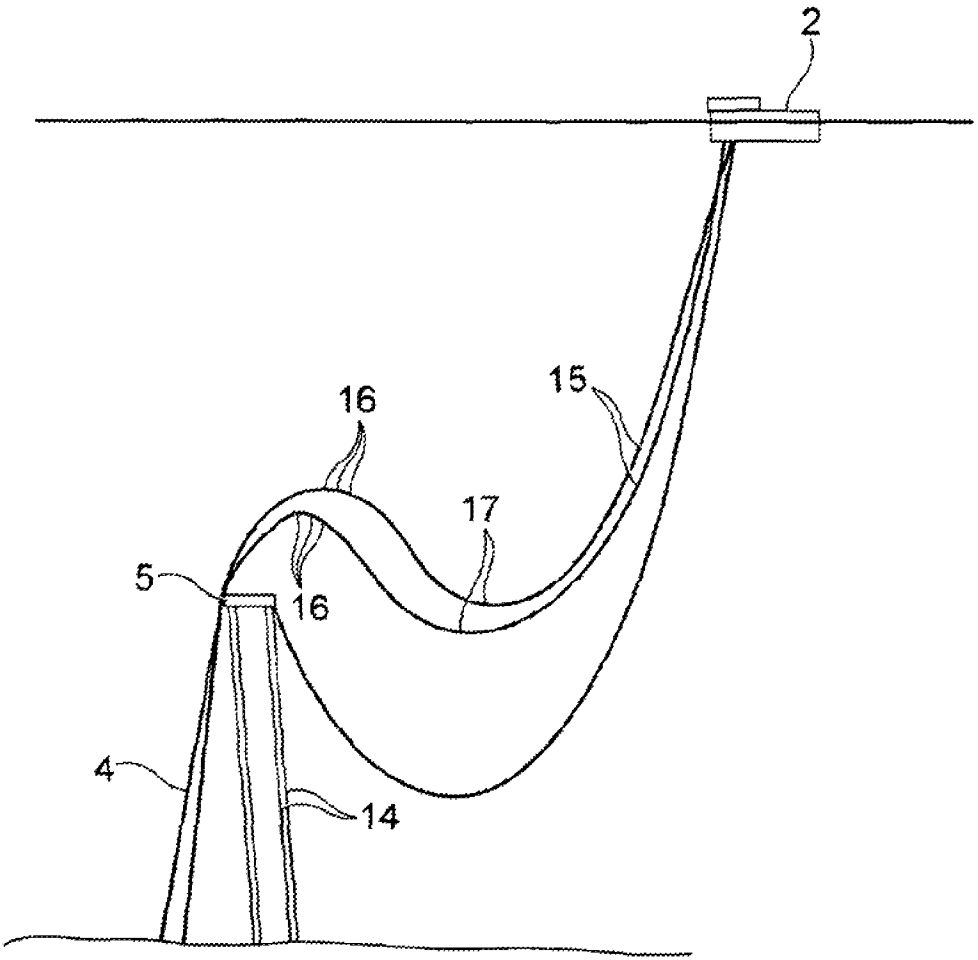
FIG. 3 is a schematic view of the riser configuration of FIG. 1 with multiple risers supported on the subsea buoy.

Whilst FIG. 1 shows a single SCR 4 connected to a single flexible riser 15 across the subsea buoy 5, it is envisaged that multiple SCRs will be tethered to the subsea buoy, each connected to a dedicated flexible riser which is held above the subsea buoy via dedicated buoyancy means This as illustrated in FIG. 3. In some embodiments for example there may be 14 SCRs docked at the subsea buoy and 5 umbilicals carrying power or other control signals between the FPSO 2, the subsea buoy 5, the SCRs 4 and equipment connected to or mounted on the subsea pipeline or on the seabed.

Adjacent flexible risers 15 can be vertically spaced or staggered, so that they do not clash with each other in their respective steep wave configurations corridors.

The flexible riser buoyancy modules 16 may have conical ends to facilitate snag-free installation or change-out, of adjacent flexible risers or umbilicals.

As a further advantage of the present invention, the flowpath for fluids from the SCR 4 through the flexible riser 15 to the FPSO 2 is improved as the number of connections between the various parts of the hybrid riser are reduced. This also provides the significant advantage of a reduction in the cost of installation of the riser system.

Furthermore, as the subsea buoy 5 can be tethered at a greater depth, umbilicals which extend from the seabed to the surface carrying power and the like and which are secured upon the subsea buoy, are also held beneath the wave profile and are therefore less likely to move in the current. The umbilicals may be bundled together in order to decrease the ration of drag to weight and are also less likely to tangle with or impact with the flexible risers 15.

It will further be appreciated that the riser configuration described above provides additional advantages in separating the high motion response of the surface vessel from the SCR which is in contact with the seabed.

Such a riser configuration as described also results in a reduced foundation size for production of fluids, shorter mooring lines with a reduction in dynamic exposure, a reduction in the SCR lengths with a consequential reduction in dynamic exposure of the SCR. Additionally, the umbilicals can also be reduced in length and the risk of umbilicals clashing with the flexible risers is also significantly reduced.

The person skilled in the art will further realise that the present invention provides for a reduction in the current loading on the subsea buoy and risers together with reduced production fluid flow resistance for the steep wave layout of the flexible riser above the subsea buoy.

In a further advantage, the various components of the riser configuration are independently replaceable. Therefore an SCR or a flexible riser may be replaced without disturbing any of the remaining components of the configuration.

Furthermore, the subsea buoy provides only a single interface with each hybrid riser which reduces the dynamic exposure of the risers. It will also be appreciated that the riser configuration as described is designed for remote operations without the need for divers in the water.

Further modifications and improvements may be made without departing from the scope of the present invention. The SCR may be protected using a internal cladding comprising a CRA (Corrosion Resistant Alloy) inconel or may comprise a stainless steel liner which mean that reeling of the SCR during installation can adversely affect the working lifetime of the SCR. It is envisaged that further improvements may be realised by replacing an upper portion of the SCR 4 by a carbon steel pipe which is connected to the SCR above the touchdown point of the SCR on the sea bed and extends to the subsea buoy. Such a carbon steel pipe may have a high chrome content which would be understood by the skilled person to be around 13% and has a higher fatigue resistance than an SCR and may therefore be reeled during installation without adversely affecting the integrity of the carbon steel pipe and therefore replacing a portion of the SCR with such steel pipe can significantly reduce the cost of installation.

Preferably a plurality of carbon steel pipes would be secured together in a rack which could be built onshore and delivered to the required offshore location as a unitary body. A number of risers may be prestrung on the rack and withdrawn at the offshore location for connection between the subsea buoy and the SCRs.

In this embodiment a standard riser connector may be provided at either end of the steel pipes for connection between the subsea buoy and the SCRs. Additional buoyancy means may be provided on the rack to assist in towing or floating of the rack to the required location and preferably such additional buoyancy means will be provided at each end of the rack with the buoyancy selected to facilitate submerged towing the rack behind a barge or other vessel with another vessel providing back-tension on the tow.

In a further modification the rack may be rolled into a bundle such that the steel pipes are held at the outer edge of the bundle. For example, a rack of 6 pipes may be rolled into a hexagonal bundle with the pipes each being held at an apex by structural members which extend between pipes. This provides a rigid structure with improved fatigue resistance which can be towed subsea out to a subsea location for connection to a preinstalled group of SCRs. Buoyancy means may be mounted on the rack or bundle during subsea towing and may be removed once the subsea installation location is reached for reuse in a later installation.

As a portion of the SCR is replaced by the steel pipe, the SCR can be confined to a greater depth which therefore further reduces the effect on the SCR of the current or wave conditions. Therefore fatigue resistance at the SCR connection with the subsea pipeline can be improved. Furthermore, the tethers connecting the subsea buoy to the seabed can also be shortened in order pull the buoy deeper and so improve the fatigue resistance.

The chambers of the tank of the subsea buoy may be selectively flooded during installation and neutralised following installation. Additionally one or more of the chambers may be selectively flooded in order to alter the buoyancy of a part of the buoy during maintenance, replacement or repair operations of the tethers.

The invention claimed is:

1. A riser configuration comprising:

a rigid pipe riser portion, a flexible pipe riser portion, and a subsea buoy supporting the rigid pipe riser portion, wherein the rigid pipe riser portion is a steel catenary riser that extends from a seabed to the subsea buoy, and the flexible pipe riser portion hangs between the subsea buoy and a sea surface with a sag bend, wherein the riser portions are connected, and wherein one or more buoyant devices are mounted on the flexible pipe riser portion to separate the sag bend from the subsea buoy.

2. A riser configuration as claimed in claim 1, wherein the buoyant devices are adapted to maintain the flexible pipe riser portion above the rigid pipe riser portion in a region of connection between the riser portions.

3. A riser configuration as claimed in claim 1 wherein the buoyant devices are adapted to maintain the flexible pipe riser portion in a steep wave configuration.

4. A riser configuration as claimed in claim 1, wherein the flexible pipe riser portion is connected to the rigid pipe riser portion by a vertical connector.

5. A riser configuration as claimed in claim 4, wherein the flexible pipe riser portion comprises a gooseneck about the vertical connector to support a change in angle of the flexible pipe riser portion.

6. A riser configuration as claimed in claim 1, wherein the buoyancy of the buoyant devices is adjustable such that the depth of the flexible pipe riser portion relative to the rigid pipe riser portion is controlled.

7. A riser configuration according to claim 6, wherein the subsea buoy comprises one or more tanks which are floodable to alter buoyancy of the subsea buoy and thus a depth at which the riser portions are connected.

8. A riser configuration as claimed in claim 1, wherein the one or more buoyant devices comprise one or more collars surrounding the flexible pipe riser portion.

9. A riser configuration as claimed in 1 wherein the one or more buoyant devices comprise one or more buoyant modules which are tethered to the flexible pipe riser portion.

10. A riser configuration as claimed in claim 9, wherein the one or more buoyant modules have conical ends.

11. A riser configuration as claimed in claim 1, wherein the buoyant devices support the weight of the flexible pipe riser portion in use, whereby the flexible pipe riser portion is self supporting.

12. A riser configuration as claimed in claim 1, wherein the subsea buoy further comprises a connector for securing the rigid pipe riser portion to the subsea buoy the connector comprising an arm extending laterally from the subsea buoy with a socket at the free end of the arm for receiving the steel catenary riser.

13. A riser configuration as claimed in claim 1, wherein the subsea buoy further comprises structural frame members connected by a pontoon.

14. A riser configuration as claimed in claim 13, wherein the pontoon is adapted to support umbilicals mounted on the subsea buoy.

15. A riser configuration as claimed in claim 1, wherein the subsea buoy is provided with a plurality of tethers to anchor the subsea buoy to the seabed.

16. A riser configuration according to claim 15, wherein the subsea buoy is tethered to the seabed at a depth which is below the local high surface current profile band.

17. A riser configuration according to claim 1, wherein the riser configuration comprises a plurality of rigid pipe riser portions and a plurality of corresponding flexible pipe riser portions.

18. A riser configuration according to claim 17, wherein adjacent flexible pipe riser portions are spaced or staggered to prevent clashing.

19. A riser configuration according to claim 7 wherein the riser configuration comprises a plurality of rigid pipe riser portions and a plurality of corresponding flexible pipe riser portions and wherein the subsea buoy comprises a plurality of tanks, wherein each of said tanks is associated with one or more rigid pipe riser portions.

* * * * *